United States Patent [19]

Jordan

[11] Patent Number: 5,059,309

[45] Date of Patent: Oct. 22, 1991

[54] ULTRASONIC FLOTATION SYSTEM

[75] Inventor: Cy E. Jordan, Tuscaloosa, Ala.

[73] Assignee: The United States of America as represented by the Secretary of the Interior, Washington, D.C.

[21] Appl. No.: 541,689

[22] Filed: Jun. 21, 1990

[51] Int. Cl.[5] ..... B03D 1/14; B03D 1/24

[52] U.S. Cl. ..... 209/164; 209/170; 210/703; 210/221.2; 241/1; 261/81; 261/DIG. 48

[58] Field of Search ..... 209/164, 168, 169, 170, 209/1; 210/221.2, 703; 241/1, 301; 261/81, DIG. 48

[56] References Cited

U.S. PATENT DOCUMENTS

| | | | |
|---|---|---|---|
| 2,093,898 | 9/1937 | Taplin | 209/170 |
| 3,400,818 | 9/1968 | Tarjan | 209/170 |
| 4,045,243 | 8/1977 | Wohlert | 209/170 |
| 4,226,705 | 10/1980 | Lecoffre | 209/170 |
| 4,537,599 | 8/1985 | Greenwald | 209/168 |
| 4,606,822 | 8/1986 | Miller | 209/170 |
| 4,613,430 | 9/1986 | Miller | 209/170 |

FOREIGN PATENT DOCUMENTS

| | | | |
|---|---|---|---|
| 201093 | 9/1986 | Japan | 209/168 |
| 589212 | 1/1978 | U.S.S.R. | 209/170 |
| 766650 | 9/1980 | U.S.S.R. | 209/169 |
| 1233943 | 12/1984 | U.S.S.R. | 209/170 |

*Primary Examiner*—Stanley S. Silverman
*Assistant Examiner*—Thomas M. Lithgow
*Attorney, Agent, or Firm*—E. Philip Koltos

[57] ABSTRACT

An ultrasound flotation unit for separation of tails from liquors obtained by floating ores, wherein the unit comprises a vertically disposed cylindrical mixing chamber that forms a bubble-particle contact region within a cylindrical flotation cell that has a bubble-pulp separation region surrounding said mixing chamber; the chamber having an air feed conduit in a lower portion thereof, an ore pulp feed conduit in a higher portion above said air feeding chamber, an ultrasonic transducer disposed above an aperture in a top portion of the mixing chamber and means for subjecting said chamber to an amount of power in kilowatt-hours per metric ton through a sonic probe to focus an amount in watt/ml of ultrasonic power to the chamber to provide a residence time of slurry within the bubble-pulp separator region that is about 30 to 100 times longer than in the ultrasonic mixing chamber.

8 Claims, 1 Drawing Sheet

ULTRASONIC FLOTATION SYSTEM

FIELD OF THE INVENTION

The present invention relates generally to an ultrasonic flotation system for use by the minerals industry for flotation of hydrophobic minerals particles or ions from an aqueous medium. The ultrasonic power is focused in a small portion of the cell (the mixing chamber) in order to effectively utilize the agitation energy to quickly attach hydrophobic particles to the bubbles. As a result of combining the ultrasonic power to a small portion of the cell, the ultrasonic vibrations provide an efficient mixing energy that creates micro-agitation within the fluid to effectively collide the mineral particles with the bubble. The ultrasonic vibrations from the flotation system generate small bubbles of air and disperse them quickly throughout the slurry in the mixing chamber and cause cavitation of the fluid at the particle surface which precipitates dissolved air upon the surface of the hydrophobic mineral particles. These small bubbles of air attach to particles faster than in the case of conventional flotation systems.

DESCRIPTION OF THE PRIOR ART

Mineral processing researchers have tried for years to utilize the micro agitation which can be provided by ultrasound to enhance the flotation separation of minerals. However, most of the literature addresses the effects of ultrasound on the ore conditioning per se prior to commencement of flotation. Some of the researchers who have reported improved flotation recovery using ultrasonically emulsified flotation collector reagents are:

Glembotski et al. "Flotation of Ores," USSR, Jan. 25, 1961, 159 pp.;

Khan et al. "Application of Ultrasound For Selection In Collective Concentrates", Inst. Steel and Alloys, Moscow, Vol. 7, No. 3, 1964, pp. 27–31; and Ponteleeva et al. "Effect of Preliminary Ultrasonic Treatment of the Pulp on Floatability", Inst. Steel and Alloys, Moscow, Vol. 7, No. 3, 1964, pp. 27–31.

Glembotski et al reported improved selectivity by ultrasonically conditioning a complex Cu-Pb or Pb-Zn ore pulp before conventional flotation separation. Ultrasound has also been used to dereagentize concentrate pulps by ultrasonically destroying the absorption layers on the mineral surfaces.

Khan et al reported that selective flotation was achieved by their technique on a mixed sulfide concentrate.

These researchers have proclaimed several reasons for improved recovery with ultrasonic treatment, such as cleaner mineral surfaces with more sites available for collector attachment, better dispersion of the ore particles, selective flocculation of the fine hydrophobic particles, and more effective dispersion and distribution of the flotation reagents among the ore particles (Sastri et al. "Some Effects of Ultrasonics and Their Application in Metallic Ore Processing", Journal of Scientific and Industrial Research, Vol. 36(8), 1977, pp. 379–385).

A few studies have been conducted using ultrasound during flotation. [1]Stoev et al studied the effect of ultrasonic dispersion of air bubbles which resulted in improved recovery of fine coal and [2]Nicol et al, investigated fine-particle flotation in an acoustic field. Improved flotation kinetics were obtained with ultrasound especially for fine size particles (minus 10 $\mu$m). These authors suggested that ultrasonic cavitation at the particle's surface caused dissolved air to precipitate out on the mineral surface. This mechanism overcomes the hydrodynamic fluid flow limitations that occur in fine particle flotation and allows improved recovery of the fine particles. However, the energy costs for the ultrasonic agitation were too high for economical application.

[1]"Flotation with Sound Carrying Bubbles," Coke Chem. Vol. 7, USSR, 1966, p. 12E. [2]"Fine-Particle Flotation in an Acoustic Field" International Journal of Mineral Processing, 17, 1986, pp. 143–150.

Recent flotation hydrodynamic research by the Bureau of Mines (Jordan et al. "New Flotation Technology to Recover Ultrafine Chalcopyrite," SME Fall Meeting, St. Louis, Mo. Preprint No. 86–335, 1987, 11 pp.) has shown the importance of turbulent agitation on the recovery of fine particles. The turbulent fluid flow contained numerous microscopic eddies that bring together the bubbles and particles more frequently than the more quiescent streamline flows. This micro-agitation increased the number of particle-bubble collisions, produced faster flotation kinetics, and resulted in higher recovery of the fine particles. However, these studies also show that the most effective agitation within a conventional flotation cell occurred in only a small portion of the flotation cell volume (Jordan et al, "Evaluation of a Turbulent Flow Model for Fine Bubble and Fine Particle Flotation," SME Annual Meeting, Las Vegas, Nev., Preprint No. 89–172, 1989, 12 pp.).

To optimize flotation the micro agitation energy should be concentrated on the ore pulp only long enough to attach the particle to the bubble.

SUMMARY OF THE INVENTION

Accordingly, it is an object of the present invention to advance the technology of flotation beneficiation by providing a continuous ultrasonic flotation unit designed to focus the microagitation of ultrasonic vibrations on the ore pulp in a small mixing chamber for short period of time.

It is another object of the present invention to provide a continuous ultrasonic flotation unit which permits a mixture of ore, water and air to be ultrasonically agitated as it is passed through a small mixing chamber.

A yet further object of the present invention is to provide a continuous ultrasonic flotation unit that permits the ultrasonic agitation to disperse the air into small bubbles that quickly attach to the hydrophobic minerals.

A further object yet still of the present invention is to provide a ultrasonic flotation system which permits the mixture to exit from the agitation chamber so that the air bubbles, with the hydrophobic particles already attached, quickly rise to the top of the separator.

A still further object of the present invention is to provide an ultrasonic flotation system which permits hydrophilic particles to settle to the bottom of the separator and be recoverable as tailings.

In achieving the foregoing and other objects in accordance with the ultrasonic flotation system of the invention as embodied and broadly described herein, a continuous ultrasonic flotation system was invented to both generate air bubbles in the ore pulp and effectively collide the newly generated bubbles with the hydrophobic ore particles. Towards these ends, two distinct regions are provided within the ultrasonic flotation cells. The first region is a bubble-particle contact region which consists of a vertical cylindrical mixing chamber that allows air to enter through a conduit at it's bottom and the conditioned ore to enter the cylinder of the mixing chamber above the entering air feedport and conduit. An ultrasonic transducer is positioned at the top where the slurry exit the mixing chamber. As the air, water and ore particles move through the mixing chamber, the ultrasonic agitation breaks the air into small bubbles and vigorously mixes the ore particles with the newly generated bubbles. At this point, the hydrophobic ore particles attach to the bubbles and leave the mixing chamber as a bubble-particle agglomerate. The second region of the sonic flotation cell is the bubble-pulp separation region formed by the cylindrical flotation cell. As the bubble-particle mixture exits the mixing chamber, it disperses within the much larger and relatively quiescent bubble pulp separator. The air bubbles with attached hydrophobic minerals rise to the top of the chamber to form a froth, and overflow along the outer edge of the cylinder. The mineral particles that are not attached to the air bubbles settle out and exit through the bottom of the flotation cell as tailings. The residence time of the slurry within the bubble-pulp separator region is from 30 to 100 times longer than the residence time in the ultrasonic mixing chamber, and this effectively concentrates the ultrasonic energy for rapid bubble-particle attachment in from about 1 to about 3% of the cell's volume.

DETAILED DESCRIPTION OF THE INVENTION

Figure 1:
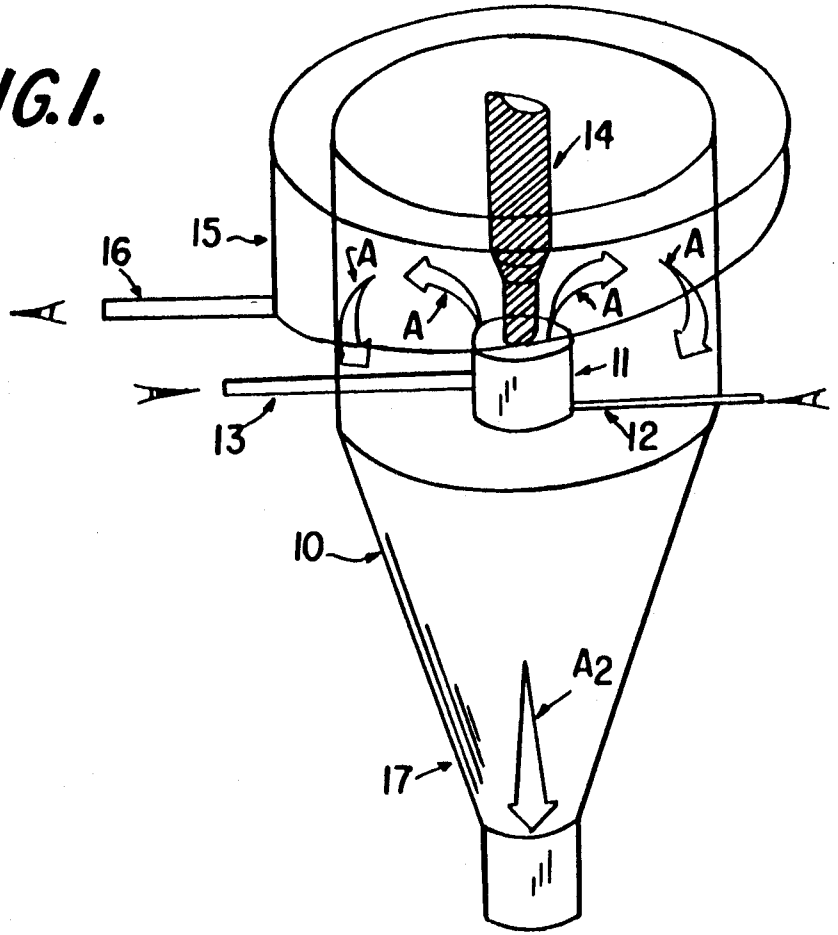
FIG. 1 shows a ultrasonic flotation cell having a first region or mixing chamber which provides bubble-particle contact from air entering the bottom of said first region and a conditioned ore entering said region above an air feedport or conduit; an ultrasonic transducer positioned at the top of said first region where the slurry exits the mixing chamber; and a second region of the sonic flotation cells where the bubble-pulp separation occurs.

In general, single and two stage processing of the ultrasound floatation system were tested. The best $P_2O_5$ recoveries were obtained at the 400 ml/minute feed rate where a 21% $P_2O_5$ concentrate was produced at a 94% recovery. At the faster feed rate, 800 ml/minute, a 19% $P_2O_5$ concentrate was produced with 91% recovery of the phosphate. In both fine and coarse phosphate flotation, two stage processing was more effective than single stage processing.

Conventional laboratory batch flotation tests were conducted with a 250-g Denver DR flotation cell on both the coarse and fine phosphate flotation feeds for comparison with the ultrasonic flotation tests. For the coarse phosphate flotation, the combined flotation concentrate was 30% $P_2O_5$ and it recovered 92% of the phosphate. The flotation rate constant was 1.26 $min^{-1}$. Kelly, E.G., D. J. Spotteswood, "Flotation and Other Surface Separations", *Introduction to Mineral Processing*, John Wiley & Sons, Inc., 1982, New York, N.Y., p. 317. The speed of flotation is expressed by a first order differential equation with a flotation constant. Plant flotation recoveries for the coarse phosphate feed are typically around 60%. Conventional laboratory flotation recovery of the coarse phosphate feed is typically higher than the recovery obtained in the plant under similar reagent dosages. Moudgil et al. "Enhanced Recovery of Coarse Particles During Phosphate Flotation," Annual Report—Florida Institute of Phosphate Research, October, 1988, 59 pp; suggested that the hydrodynamics of the laboratory flotation cell were much more effective than the plant scale flotation cells. For the fine phosphate flotation feed, the conventional laboratory flotation cell produced a 27% $P_2O_5$ concentrate and recovered 91% of the phosphate. Its flotation rate constant was slightly lower at 1.20 $min^{-1}$. These results are comparable to typical phosphate results and formed the baseline for comparison with the test results from the ultrasonic flotation tests. The ultrasonic flotation tests were similar in grade and recovery to the conventional laboratory flotation tests. However, the flotation rate was 2.5 times faster for the ultrasonic flotation cell than the laboratory conventional flotation cell.

In selecting the best overall conditions for ultrasonic flotation, the concentrate grade, phosphate recovery, flotation rate and energy consumption must all be balanced. The best grade and phosphate recovery for the coarse feed was obtained at a relatively slow flotation rate and with a high energy consumption. As shown in table 1, 94% recovery of the phosphate was obtained for the coarse feed at a power consumption of 6.8 (kilowatt-hours per metric ton) kW.h/mt. By increasing the feed rate to 1,000 ml/minute the energy requirements decreased to 4.3 kW.h/mt with a corresponding decrease in phosphate recovery from 94 to 84%. This data shows that by sacrificing $P_2O_5$ recovery, the energy consumption can be lowered and the flotation rate can be increased. For the fine feed, increasing the feed rate lowered the energy requirements from 7.5 to 3.0 kW.h/mt while the phosphate recovery remained the same.

TABLE 1

Comparison of ultrasonic flotation results at two different[1] power levels for coarse and fine phosphate flotation.

| | Feed rate, ml/minute | | | |
|---|---|---|---|---|
| | Coarse feed | | Fine feed | |
| | 500 | 1000 | 400 | 800 |
| Air to ore ratio ml/g | 5.5 | 5.5 | 9.5 | 9.5 |
| Concentrate grade pct P205 | 30 | 30 | 19 | 20 |
| P205 recovery % | 94 | 84 | 91 | 90 |
| Flotation rate constant $min^{-1}$ | 1.95 | 3.6 | 4.1 | 4.7 |
| Power consumption kW · h/mt | | 4.3 | 7.5 | 3.0 |

[1]For two stages of flotation

To optimize the system for a given ore, the factors of cost, production capacity, recovery and grade must all be considered. The system was tested with a phosphate ore, but will work just as well on other ores. The ore contained phosphate and quartz and ranged in particle size from 400 mesh (38 μm) to 16 mesh (1000 μm). To simulate a typical Florida phosphate operation, the ore was split into size fractions (Lawver, 1983), coarse feed (420 μm to 100 μm size) and fine feed (32 μm to 420 μm size). Each test sample was conditioned with fatty acid at 67% pct solids for 5 minutes in a slow speed mixer. For the coarse phosphate conditioning, 0.4 g/kg fatty acid was used. The fine phosphate flotation feed was conditioned with 0.4 g/kg fatty acid and 0.2 g/kg sodium silicate to depress the fine silica. After conditioning the sample was placed in a feeding tank diluted with water and frother (Dowfroth 1012) to a concentration of 25 ppm frother. The feed slurry was pumped to the ultrasonic cell at a fixed feed rate until the conditioned ore sample was depleted.

During testing, the effect of flotation staging was investigated by passing the wet tailings product through the ultrasonic flotation cell again. During the second pass or procesing through the ultrasonic flotation cell, no additional reagents were used. Timed samples of the first and second concentrates and the final tailings were dried and analyzed for $P_2O_5$.

Several feed rates and airflow rates were tested along with the two mixing chambers, the three ultrasonic probe positions, and the single or two stage process. Factorial designs of the experiments were conducted to maximize the experimental data, quantify the reproducibility, and minimize the number of experiments. A two by three factorial design was conducted on the coarse phosphate feed, to test the effect of agitation chamber type and position of the ultrasonic probe. The 33% solids coarse phosphate was fed to the ultrasonic system at 500 ml/minute and at an air to ore ratio of 10.3 ml air per gram of ore. Mixing chamber #1 and #2 were tested with the ultrasonic probe positioned 10 mm below, evenwith, and 10 mm above the top of the mixing chamber. Statistically, there was no significant variation in the product phosphate grade, which averaged about 27% $P_2O_5$. The best results were obtained with mixing chamber #1 with the ultrasonic probe even with the top of the mixing chamber. The product grade was 27% $P_2O_5$, the flotation rate was 3.14 $min^{-1}$, and the phosphate recovery was 92%. The energy consumption for both mixing chambers was 6.8 kW.h/mt of feed.

A similar factorial design was conducted using the fine phosphate which was fed at 50% solids and 400 ml/minute with an air to ore ratio of 9.5 ml/g. The mixing chamber type and the position of the ultrasonic probe had no effect upon the product grade which averaged 22% $P_2O_5$. The best flotation rate constant of 3.76 $min^{-1}$ was obtained with the ultrasonic probe 10 mm below the top of the #1 mixing chamber.

A three by three factorial design was conducted to study the effect of feed rate, air to ore ratio and flotation staging. A 33% solids coarse phosphate slurry was fed at 500, 1000, and 2000 ml/minute with air to ore ratios of 5.5, 10.3, and 23.5 ml/g. Only the #1 mixing chamber was tested and the ultrasonic probe was positioned even with the top of the mixing chamber. Each sample was passed through the system twice to determine the effect of flotation staging. The best conditions for the coarse phosphate feed occurred at a feed rate of 500 ml/minute, 5.5 ml/g air to ore ratio, and two stages. A 30% $P_2O_5$ concentrate was produced that recovered 94% of the phosphate. The flotation rate constant was 1.95 $min^{-1}$, conventional laboratory flotation cell.

The fine phosphate ore feed was also tested in a factorially designed experiment with two feed rates, three air to ore ratios, and two types of flotation staging using mixing chamber #1. The fine phosphate was fed at 50% solids at 400 ml/minute and 800 ml/minute. The air to ore ratio ranged from 4.3 to 13.0 mL/g, and both single and two stage processing were tested. The best $P_2O_5$ recoveries were obtained at the 400 mL/min feed rate where a 21 pct $P_2O_5$ concentrate was produced at a 94 pct recovery. At the faster feed rate, 800 mL/min, a 19 pct $P_2O_5$ concentrate was produced with 91 pct recovery of the phosphate. As it was with the coarse phosphate flotation, two stage processing was more effective than the single stage process. The continuous ultrasonic flotation system is designed to both generate air bubbles in the ore pulp and effectively collide the newly generated bubbles with the hydrophobic ore particles.

As shown in FIG. 1, there are two distinct regions within the ultrasonic flotation cell 10. The first region 11 is the bubble-particle contact region which consists of a vertical cylindrical mixing chamber. The air enters a conduit 12 at the bottom and the conditioned ore enters the cylinder mixing chamber through a conduit 13 above the air feedport. The ultrasonic transducer probe 14 is positioned at the top where the slurry exits the mixing chamber, as depicted by arrows A. As the air, water, and ore particles move through the mixing chamber the ultrasonic agitation breaks the air into small bubbles and vigorously mixes the ore particles with the newly generated bubbles. The hydrophobic ore particles attach to the bubbles and leave the mixing chamber as a bubble-particle agglomerate. The second region of the sonic flotation cell is the bubble-pulp separation region 15. This region is formed by the cylindrical flotation cell. As the bubble-particle mixture exits the mixing chamber, it disperses within the much larger and relatively quiescent bubble pulp separator. The air bubbles with attached hydrophobic minerals rise to the top of the cylinder, form a froth, and overflow along the outer edge of the cylinder through conduit 16. The mineral particles that are not attached to the air bubbles settle out and exit through the bottom of the flotation cell. The residence time of the slurry within the bubble-pulp separator region is 30 to 100 times longer than the residence time in the ultrasonic mixing chamber. As already mentioned, this effectively concentrates the ultrasonic energy for rapid bubble-particle attachment in 1 to 3% of the cell's volume.

For the prototype, two different mixing chambers were tested. Each mixing chamber being designed to provide 1 to 2 watt/ml of ultrasonic power within the mixing chamber. The height to diameter ratio of the mixing chamber was also varied between 1:1 to 3:1. The first mixing chamber (#1) was 25 mm diameter and 25 mm high. The air feed port was at the bottom and the ore feed port was 10 mm from the bottom. The second mixing chamber (#2) was 18 mm diameter and 60 mm high. It's air feed port was also at the bottom, but the feed port was 20 mm up from the bottom. The ultrasonic agitation was supplied by a Sonicator Ultrasonic Liquid Processor. The 20-kHz ultrasonic vibrations from the transducer crystals were amplified through an acoustic horn called a probe that focussed the ultrasonic vibrations on a flat, 12-mm-diameter tip. This tip was centered near the top of the mixing chamber. Tests were conducted at three different tip positions, 10 mm down from the top, even with the top, and 10 mm above the top of the mixing chamber. The effective volumes of the mixing chamber depended upon the position of the ultrasonic probe tip and ranged from 6 to 12 ml for the 1 chamber and 8 to 12 ml for the #2 chamber. The agitated mixture exited the mixing chamber through an aperture created by the top of the mixing chamber and ultrasonic probe. Power measurements were recorded for each test and converted to kilowatt-hours per metric ton (kW.h/mt) of feed. The bubble-pulp separator region was formed by a 100-mm-diameter cylinder. At the top of the bubble-pulp separation region, a shallow froth developed and overflowed the top edge forming the flotation concentrate. The effective volume of the bubble-pulp separator was defined as the region from the top of the mixing chamber to the top of the bubble-pulp separator. These effective volumes ranged from 390 to 670 mL depending upon the mixing chamber and the ultrasonic probe tip position. The region outside and below the top of the mixing chamber is the tailings consolidation zone 17 where the unattached particles descended as shown by arrow $A_2$. These particles settled and were removed by a small pump (not shown) in the tailings region. The overall dimensions of the prototype ultrasonic flotation cell were 100 mm diameter and 100 mm high. A liquid overflow (not shown) was attached to the flotation cell to maintain a constant height of fluid within the ultrasonic flotation cell. The height of this overflow pipe is adjustable and depended upon the feedrate of the system.

It is apparent from the foregoing that the ultrasonic flotation system provides several advantages over conventional flotation systems, not the least of which are:

1) Focussing the ultrasonic power in a small portion of the cell (the mixing chamber) effectively utilizes the agitation energy to quickly attach the hydrophobic mineral particles to the bubbles and the mixing energy is efficiently used by this technique;
2) The ultrasonic vibrations create micro-agitation within the fluid to effectively collide the particles with the bubbles;
3) The ultrasonic vibrations generate small bubbles of air and disperse them quickly throughout the slurry in the mixing chamber; and
4) The ultrasonic vibrations cause cavitation of the fluid at the particle surface which precipitates dissolved air upon the surface of the hydrophobic particles and these small bubbles of air attach to the particles faster than would be the case when using conventional flotation systems.

While the foregoing description and illustrations of the present invention have been shown in detail with reference to preferred embodiments as well as alternate modifications thereof, it is to be understood by those skilled in the art that the foregoing and other modifications are illustrative only, and that equivalent changes may be employed, without departing from the spirit and scope of the invention, which is defined by the appended claims.

What is claimed is:

1. A process of using an ultrasonic flotation cell to separate hydrophobic particles form hydrophilic particles contained in an ore pulp, said cell comprising cell means and a vertically disposed cylindrical chamber that forms a mixing chamber and defines a bubble particle contact region that is disposed within said cell means, said cell means forms a bubble-pulp separation region to obtain improved flotation speeds and metal recovery values while reducing power consumption requirements comprising:

feeding air through a conduit that enters a lower portion of said mixing chamber; feeding said ore pulp through a conduit entering a higher portion of said mixing chamber above said air feeding conduit;

positioning an ultrasonic transducer probe above an outlet aperture in a top portion of said mixing chamber where slurry exits to said bubble pulp separation region; subjecting said bubble particle contact region in said mixing chamber to said ultrasonic probe for concentrating an effective amount of ultrasonic power in from about 1 to about 3% of the cell volume on the ore pulp in said mixing chamber to quickly attach hydrophobic particles to bubbles by creating micro-agitation to collide said hydrophobic particles and said bubbles and disperse the particles throughout a slurry in said mixing chamber and cause cavitation of fluid at particle surfaces to precipitate dissolved air upon hydrophobic particle surfaces; and separating air bubbles attached to hydrophobic particles as they rise to a top portion of said cell means as froth from hydrophilic particles not attached to said bubbles that settle and exit through a bottom of said cell means as a tailings.

2. The process of claim 1, wherein the ore is a phosphate ore of coarse feed between 421 to 1000 μm, residence time of said slurry within the bubble-pulp separation region is 30 to 100 times longer than in the ultrasonic mixing chamber, feed rates of the slurry is about 500 to 2000 mL/minute and air to ore ratios are from about 5.5 to about 23.5 mL/g.

3. The process of claim 1 wherein the ore is a phosphate ore of fine feed between 38 to 420 μm, residence time of said slurry within the bubble-pulp separation region is 30 to 100 times longer than in the ultrasonic mixing chamber, feed rate of the slurry is between about 400 to 800 mL/minute and air to ore ratios are from about 4.3 to about 13.0 mL/g.

4. The process of claim 2, wherein the watt/ml of ultrasonic power applied to said mixing chamber is from about 1 to about 2.

5. The process of claim 3, wherein the watt/ml of ultrasonic power applied to said mixing chamber is from about 1 to about 2.

6. The process of claim. 4, wherein the tailings from said first flotation run are fed through said ore pulp conduit for at least an additional flotation run; and the power consumption in said additional flotation run is from about 4.3 to about 6.8 kilowatt-hours per metric ton at a flotation rate constant minute$^{-1}$ of between about 1.95 to about 3.6.

7. The process of claim 5, wherein tailings from said first flotation run are fed through said ore pulp conduit for at least an additional flotation run, and the power consumption in said additional flotation run is from about 3.0 to about 7.5 kilowatt-hours per metric ton at a flotation rate constant minute $^{-1}$ of between about 4.1 to about 4.7.

8. In an ultrasonic flotation cell for solid/liquid separation of tails from liquors, ores or wastes, the improvement wherein said cell comprises a vertically disposed cylindrical mixing chamber that forms a bubble-particle contact region that is from about 1 to about 3% of the cell volume and a bubble-pulp separation region defined as within said flotation cell and surrounding said mixing chamber; said chamber having an air feed conduit in a lower portion thereof, an ore pulp feed conduit in a higher portion above said air feeding chamber, an ultrasonic transducer probe means disposed above an outlet aperture in a top portion of said mixing chamber where slurry exits from said mixing chamber to said bubble pulp separation region and said ultrasonic probe means are for subjecting said mixing chamber to an amount of power to quickly attach hydrophobic particles to said bubbles and to obtain a residence time of slurrying within the bubble-pulp separator region that is about 30 to 100 times longer than the residence time in the mixing chamber.

* * * * *